US006334347B1

(12) United States Patent
Iscla

(10) Patent No.: US 6,334,347 B1
(45) Date of Patent: Jan. 1, 2002

(54) ELECTRONIC LOCK WITH MECHANICAL CLUTCH

(75) Inventor: Michel Iscla, Olivet (FR)

(73) Assignee: Electronic Key System (EKS) S.A.R.L., Luxembourg (LU)

( * ) Notice: Subject to any disclaimer, the term of this patent is extended or adjusted under 35 U.S.C. 154(b) by 0 days.

(21) Appl. No.: 09/701,044

(22) Filed: Nov. 22, 2000

(30) Foreign Application Priority Data

May 27, 1998 (FR) ..... 98 06642

(51) Int. Cl.[7] ..... E05B 49/02
(52) U.S. Cl. ..... 70/278.3; 70/283.1; 70/277
(58) Field of Search ..... 70/276–278.1, 70/278.3, 279–283, 379 R, 380, 337, 340, 221–224, 467–472

(56) References Cited

U.S. PATENT DOCUMENTS

| | | | | |
|---|---|---|---|---|
| 4,856,310 A | | 8/1989 | Parienti | 70/379 R |
| 5,628,217 A | * | 5/1997 | Herrera | 70/278.3 |
| 5,685,182 A | * | 11/1997 | Chhatwal | 70/278.3 X |
| 5,782,118 A | * | 7/1998 | Chamberlain et al. | 70/278.3 |
| 5,826,450 A | * | 10/1998 | Lerchner et al. | 70/278.3 |
| 5,946,956 A | * | 9/1999 | Hotzl | 70/278.3 X |
| 6,227,020 B1 | * | 5/2001 | Lerchner | 70/278.3 |

FOREIGN PATENT DOCUMENTS

| | | | | |
|---|---|---|---|---|
| DE | 196 03 320 A1 | | 8/1997 | |
| EP | 0 401 647 | | 12/1990 | |
| EP | 462316 | * | 12/1991 | 70/278.3 |
| FR | 2 655 367 | | 12/1989 | |
| GB | 2178476 | * | 2/1987 | 70/278.3 |
| WO | WO 9602721a1 | | 2/1996 | |
| WO | WO 98/15703 | | 4/1998 | |
| WO | WO 99/61728 | | 12/1999 | |

* cited by examiner

*Primary Examiner*—Suzanne Dino Barrett
(74) *Attorney, Agent, or Firm*—Sughrue Mion, PLLC

(57) ABSTRACT

Electronic barrel comprising a barrel body and a rotary-lock key bit, the barrel body comprising at least one rotor having a common axis with the body and the rotary-lock key bit and freely rotating in said body, a clutch part coupled in rotation with the rotor and comprising meshing means co-operation with additional means matching the key bit so as to drive in rotation said key bit by the rotor under the action of a rotating torque of the key, and locking means for preventing the clutch part from being translated when there is no recognition of an identification code transmitted between the key and the barrel, characterised in that said locking means are further mounted integral in the rotary-lock key bit and the rotor is mobile in translation for thrusting the clutch part towards the key bit when said identification code is recognised.

22 Claims, 5 Drawing Sheets

ELECTRONIC LOCK WITH MECHANICAL CLUTCH

TECHNICAL FIELD

The present invention concerns an electronic lock able to be unlocked by a key having a right of access recognised by an identification code.

BACKGROUND ART

At the current moment, most of the conventional or safety locks available on the market are mechanical locks. However, there are certain locks, namely electromechanical locks, which match conventional mechanical coding (resulting from the profile often produced from the blade of the key) with an electronic coding.

Furthermore, the patent U.S. No. 4,856,310 describes another type of lock, known as an electronic lock able to be locked and unlocked from comparing an identification code present in both the lock and the key without it being necessary to add to it any additional mechanical coding. However, this type of lock, which is fully electronic, is still not available on the market, and in fact there are good reasons for this, namely that it still has a number of particularly significant drawbacks which in practice prevents it from being commercialised. First of all, if for example the key is lost, it proves to be impossible to modify the identification, codes without contacting the manufacturer of the lock. In addition, the feeding of these locks with energy is assumed to be effected by batteries which constitutes a problem having regard to their limited periods of life. Finally, the internal structure of these locks and in particular their barrel is still particularly complex (as often merely adapted from conventional mechanical locks) and especially less reliable as shown by the structure of the barrel (basically from several springs compressed in the rest position) of said patent.

This first two problems have fortunately been resolved. In fact, with the European patent application EP-A-805-906, the Luxembourg company Electronic key systems (EKS) limited has resolved the problem of modifying the identification code of the lock by adding programming means to the key enabling the user to directly carry out this modification. Similarly, the feeding with energy problem was also resolved shortly afterwards by the international PCT patent application WO 97/48867 filed in the name of this same company which proposed using a key having autonomous energy generation means. Thus, it merely remains to currently find for these electronic locks a simple barrel structure to finally, and contrary to all expectations, enable these locks to be commercialised.

OBJECT AND DEFINITION OF THE INVENTION

Thus, the object of the present invention is to provide an electronic barrel with a simple structure adapted to an electronic environment and comprising in particular an extremely limited number of internal parts. One aim of the invention is also to provide a particularly reliable (sturdy) and high-performance barrel with a reduced energy consumption. A further aim is to obtain a barrel fully protected from impacts, vibrations or dust. Again, another aim of the invention is to produce a barrel resistant to tearing, sinking in or picking (anti forcible entry protection). Another aim is also to be able to easily manage key conflicts.

These aims can be obtained by providing an electronic barrel comprising a barrel body and a rotary-lock key bit, the barrel body comprising at least one rotor having a common axis with the body and the rotary-lock key bit and freely rotating inside said body, a clutch part coupled in rotation with the rotor and comprising meshing means co-operating with additional means of the key bit so as to drive in rotation said key bit by the rotor by the action of a rotating torque of the key, and locking means for preventing the clutch part from being translated when there is no recognition of an identification code transmitted between the key and the barrel, characterised in that said locking means are further mounted integral in the rotary-lock key bit and in that said rotor is mobile in translation for thrusting the clutch part towards the key bit when said identification code is recognised.

By means of this structure with a particularly limited number of mechanical parts, movement of the key bit can be easily effected through the clutch part from the single rotation torque of the key without control of the locking (unlocking) means requiring a great amount of energy.

The stop of the electronic barrel is preferably constituted by a single protection flap pivoting around an axis parallel to the axis of at least one rotor between an initial position and a final freeing position. The protection flap acts against the action of a return spring for automatically bringing back this flap into its initial position when the key is removed.

The motor means preferably comprise an electric microactuator with an axis parallel to the axis of at least one rotor, the freeing of at least one stop being carried out by means of a drive pinion borne by a final drive shaft of the electric microactuator and gearing on a sector gear integral with the stop.

The clutch part is formed of a cylindrical ring fitted with a central disk and comprising on both sides of this central disk groove-shaped mesh means for providing linking in rotation firstly with the key bit and secondly with the rotor. The central disk of the clutch part comprises a central heel for co-operating with the stop for freeing this part.

According to one embodiment characteristic, the electronic barrel further comprises at least one compression spring inserted between the rotor and the clutch part. It may further comprise at least one return clamp integral with the rotor and intended to co-operate with the clutch part to enable it to be freed from the key bit when the key is removed. The return clamp preferably comprises an annular disk fitted with at least one foot traversing the clutch part and fixed to the rotor, the disk co-operating with a surface of the clutch part perpendicular to the axis of at least one rotor.

According to another embodiment characteristic, the electronic barrel further comprises at least one circlip integral with the body of the barrel and intended to limit the translation of at least one rotor in the direction of the key bit.

Again, according to another embodiment characteristic, the electronic barrel comprises at least one disengaging finger formed of two independent portions spaced by a single compression spring and intended to ensure locking of the key in the rotor so as to enable the clutch part to be freed from the rotary key bit when the key is removed. This disengaging finger is preferably mounted perpendicular to the axis of at least one rotor in an opening partly traversing the rotor, a first extremity of this disengaging finger being flush inside the key pipe so as to come into contact with an orifice of the key and a second extremity going past the external wall of the rotor so as to come into contact with a longitudinal groove of the internal wall of the body of the barrel. The groove of the internal wall of the body of the barrel may comprise at least one slanted portion to facilitate compression of the sole spring when the rotor is moved after the key is introduced. Thus, the removal of the key is impossible outside an angular position defined by the precise location of the groove.

The key bit preferably comprises an annular conductive track for co-operating with a sole fixed electric contact of the body of the barrel so as to provide it with energy from motor means. Similarly, the barrel body comprises at least one perforation perpendicular to the axis of at least one rotor for receiving an electric contact, preferably of the ball type, so as to co-operate with a corresponding conductive element of the key. Electronic circuits placed in a cavity of the body of the barrel and connected firstly to at least one electric ball contact and secondly to the sole fixed electric contact are further provided so that feeding from the motor means of the key bit can be effected directly from the key through the electronic circuits.

According to a preferred embodiment, the electronic barrel of the invention comprises a first rotor or internal rotor and a second rotor or external rotor, and the width of the protection flap of the external rotor is larger than that of the protection flap of the internal rotor so that the introduction of a key into the external key pipe does not allow driving of the key bit in the presence of a key not recognised in the internal key pipe. In this case, at least one linking barrel with a length greater than the width of the key bit placed at the level of this key bit btween the return clamps, this linking barrel being intended to co-operate with the latter so as to prevent the simultaneous engaging of the internal and external rotors when two keys are introduced into the two key pipes.

The invention also concerns a lock with one or two rotors fitted with an electronic barrel as mentioned above.

BRIEF DESCRIPTION OF THE DRAWINGS

Other characteristics and advantages of the present invention shall appear more clearly from a reading of the following description given by way of non-restrictive example with reference to the accompanying drawings on which.

DETAILED DESCRIPTION OF A PREFERRED EMBODIMENT

Figure 1:
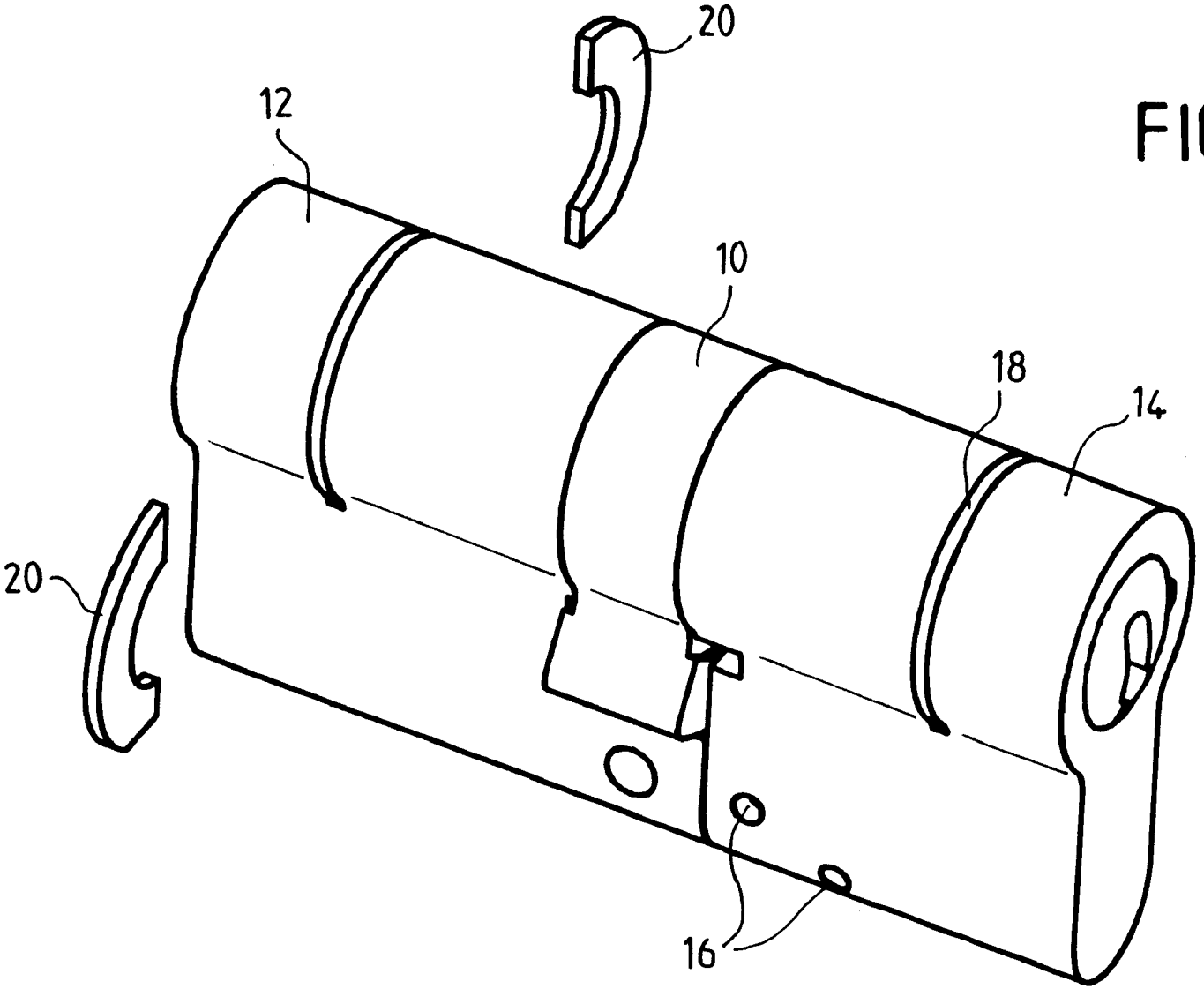
FIG. 1 is an external perspective view of a barrel of an electronic lock according to the invention.

FIG. 1 shows in external perspective an embodiment example of a barrel of an electronic lock according to the invention. This barrel, which conforms in size to a conventional mechanical double cylinder (for example of the symmetrical European double inlet type as illustrated) conventionally comprises mounted between two upstream and downstream body portions 12, 14 an intermediate rotary locking key bit 10 for actuating the bolt (not shown) of this lock. One of these two upstream and downstream portions is nested inside the other, for example with the aid of a linking finger extending from the upstream body portion and fixed in a corresponding opening of the downstream body portion (see FIG. 3) with the aid of any fixing elements (for example two screws 16).

Each body portion is traversed by two half circlips 18, 20 (shown outside the barrel) whose function is to be stated later. So as to prevent any loss of these circlips, two upstream and downstream retaining rings (not shown) can be easily forcefully mounted to cover these two body portions of the barrel. However, any other sort of means for protecting these circlips can be used to prevent removal by providing a seal by a weld or solder in the body portions or providing full cover by a simple cap.

It shall be noted that in the initial idle position (no key) as shown, the key bit is slightly slanted with respect to vertical.

Of course, the invention would not be limited to this sole embodiment example of a European double cylinder type barrel and naturally is applicable in all types of European and international barrels (and even possibly non-standardised models), for example in a button single cylinder barrel or half-cylinder type barrel.

Figure 2:
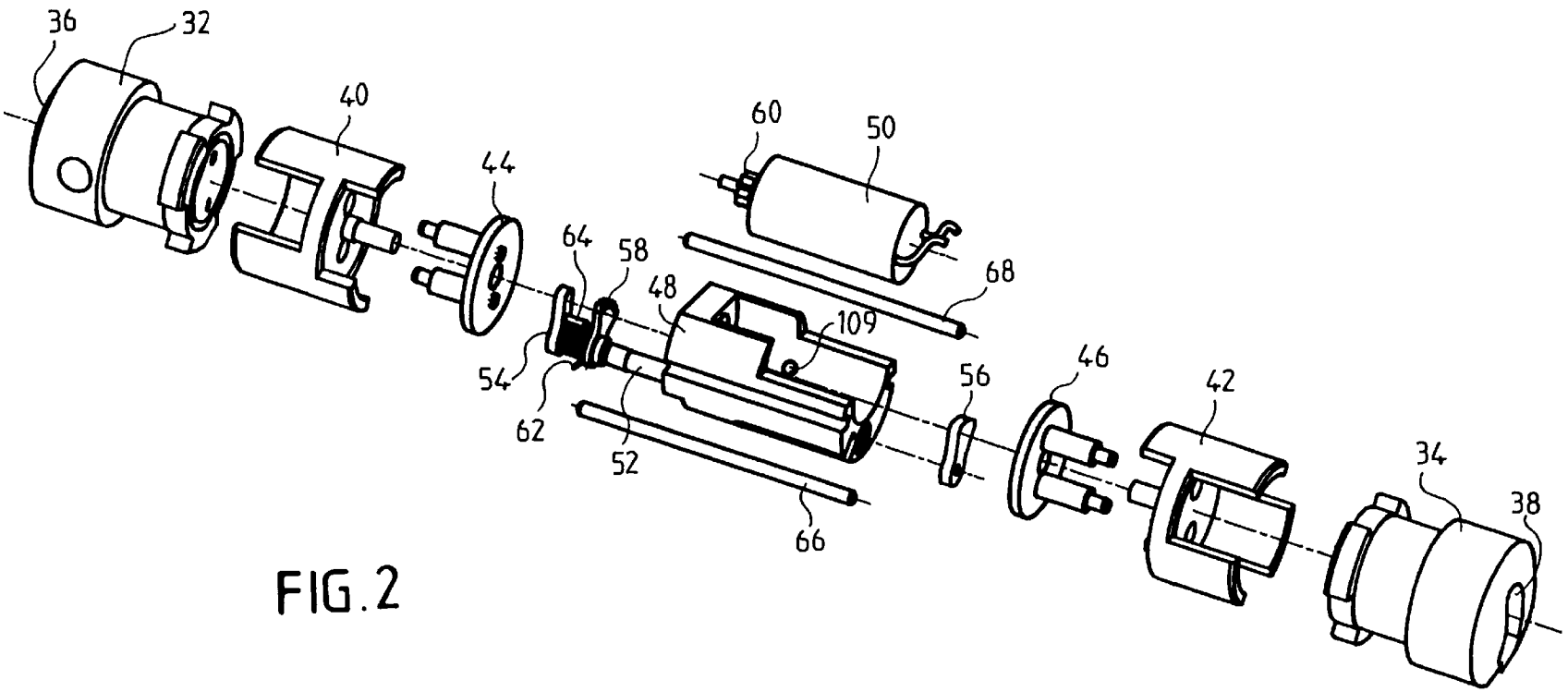
FIG. 2 is an exploded view showing the various internal components of the barrel of FIG. 1.

Details of the main internal parts constituting the barrel is illustrated in an exploded view on FIG. 2. Starting from either of the two upstream and downstream extremities of the barrel and being directed towards its centre where the key bit is situated, this figure shows: an upstream or downstream rotor (internal 32 and external 34 rotors respectively) in which a duct 36 (respectively 38) is made to receive a key 8 (more specifically the rod or blade of this key), a clutch part 40 (respectively 42) driven by the rotor and intended to gear with is the key bit 10, and a return clamp 44 (respectively 46) integral with the rotor.

Placed between the two upstream and downstream clamps, that is approximately at the level of the key bit, is a support 48 for receiving an electric actuator, such as a micromotor 50, and which is traversed by a support spindle 52 bearing fixed at each of its two extremities a stop constituted by a protection flap 54, 56. Freeing by the pivoting of these flaps (in the case of recognition of an identification code) is ensured with the aid of a sector gear 58 also fixed integral with the support spindle 52 and in gear with a drive pinion 60 borne by a final drive shaft of the micromotor 50. A wound return spring 62 is mounted on the support spindle 52 and co-operates with a spring stop 64 so as to allow an automatic return of the protection flaps 54, 56 when the key is removed.

Of course, this embodiment example with protection flaps pivoting under the action of a rotary micromotor is in no way restrictive and it is quite possible to provide an axial stop being freed with the aid of a linear micromotor.

Finally, two linking barrels 66, 68 (without this number being restrictive), whose length is larger than the width of the key bit, are provided to slide on each side of the support 48 and define a minimal distance between the upstream and downstream return clamps 44 and 46 respectively and thus prevent any simultaneous engaging of the two rotors on the key bit 10 should two keys be simultaneously introduced on each side of the barrel.

Figure 3:
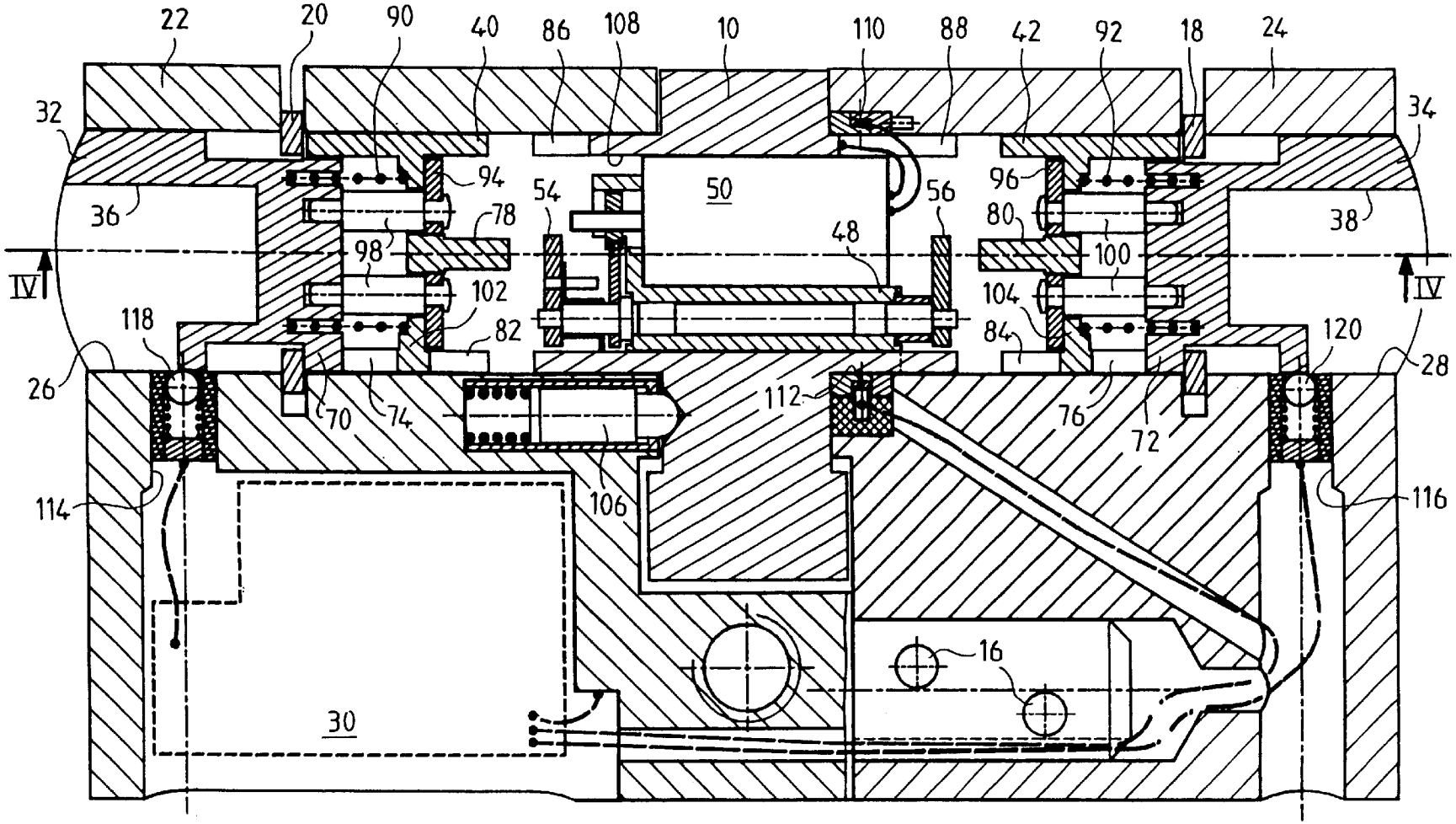
FIG. 3 is a cross section of the barrel of FIG. 1.
Figure 4:
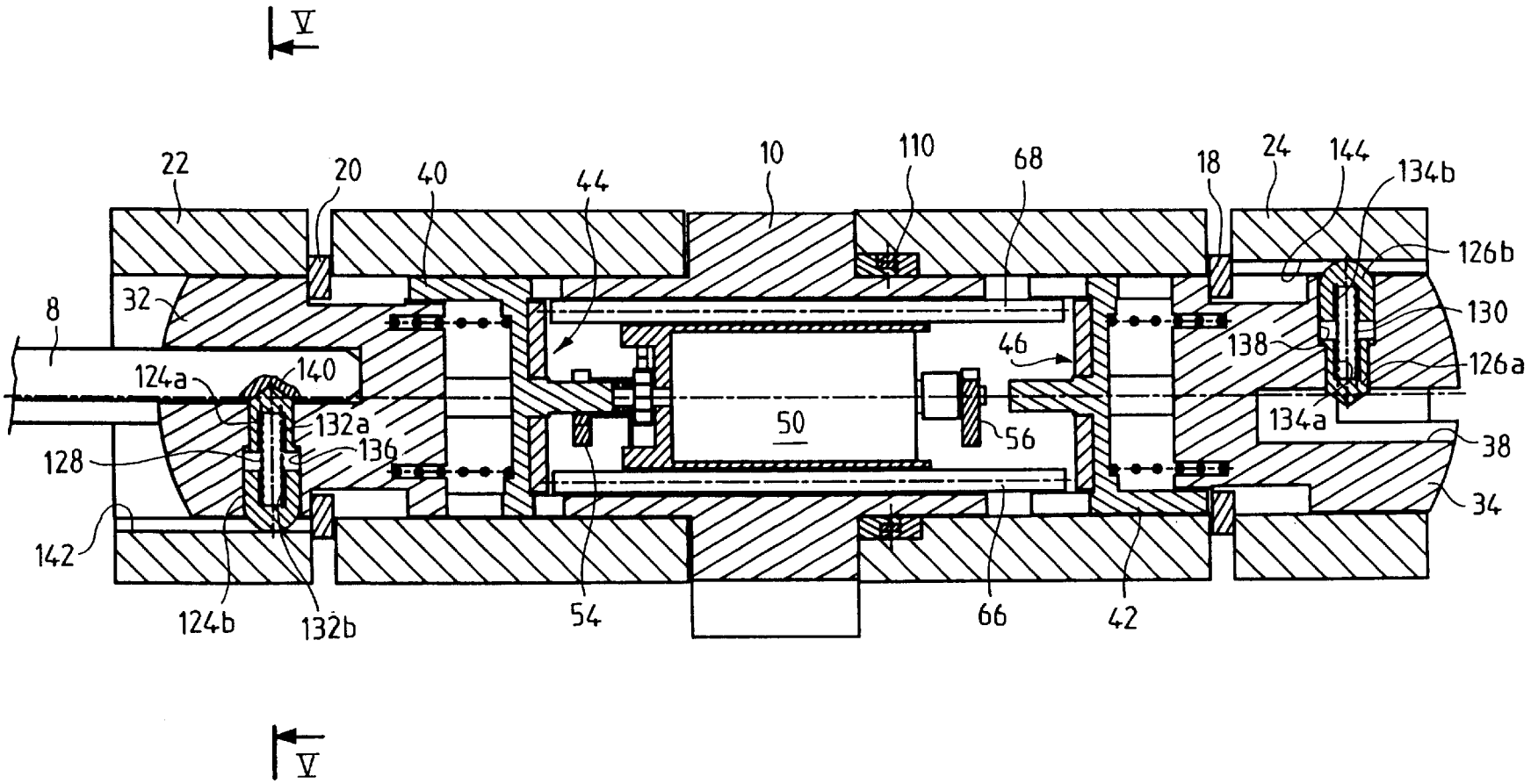
FIG. 4 is a section along the plane IV—IV of FIG. 3.

FIGS. 3 and 4 are sectional views of the electronic barrel of FIG. 1 which more specifically show the position of the internal parts as illustrated on FIG. 2. FIG. 3 is made inside the vertical plane of symmetry of the barrel, and FIG. 4, which is shown with the key 8 introduced into the internal rotor, is embodied in a horizontal plane passing through the axis of symmetry of the rotors. The locking key bit 10 is shown mounted between an internal stator 22 and an external stator 24 forming the external portions of the body of the barrel. The internal stator is rendered integral with the external stator by a linking finger traversed by two screws or fixing pins 16. These two stators are each provided with a longitudinal cylindrical perforation 26, 28 having a common axis and in which the main internal components of the barrel are placed. One of these stators, such as the internal stator 22, is further fitted with a cavity to receive the electronic circuits of the barrel 30.

In the upstream portion of the barrel (the various parts described hereafter are identical in the downstream portion), the internal rotor 32 (downstream reference 34) is mobile in translation in the internal stator 22 (24) between an idle position (no key present) and an opening position limiting translation of the rotor in the direction of the key bit and in which this rotor is in contact with the upstream circlip 18, 20.

At one of its two extremities, the rotor comprises the key duct 36 (38) and at the other extremity a first engaging element 70 (72) for co-operating with a second corresponding engaging element 74 (76) of the clutch part 40 (42). This clutch part, which is fitted with an axial protuberance or central heel 78 (80) for co-operating with the freeing stop, further comprises a third engaging element 82 (84) for co-operating with a fourth additional engaging element 86 (88) of the key bit so as to have the key bit driven in rotation by the rotor under the action of the rotation torque of the key 8. An elastic linking element, such as a helical compression spring 90 (92) is inserted between the rotor and the clutch part.

The return clamp 44 (46) is formed of an annular disk 94 (96) fixed to at least one foot 98 (100) traversing the clutch part and whose free extremities are for example screwed or crimped in the rotor 32 (34). The clutch part is formed of a cylindrical ring fitted with a central disk 102 (104) and comprising on both sides of this central disk the engaging means 74, 82 (76, 84) in the form of grooves to ensure the linking in rotation firstly with the key bit and secondly with the rotor. The central disk of the clutch part is preferably intended to co-operate with the annular disk of the return clamp.

The key bit 10, whose positioning is ensured by a conventional indexing device 106 comprising an indexing finger compressing a spring in an opening of one of the stators (for example the internal stator 22), is also fitted with a longitudinal perforation 108 whose axis coincides with that of the longitudinal perforations of the stators and which is intended to receive the micromotor 50 and its support 48. The support and its motor are rendered integral with the key bit by any fixing means (for example a screw whose passage orifice through the support is given the reference 109 on FIG. 2), the support axis of the protection flaps 54, 56 traversing this support.

It shall be observed that, so as to effectively manage the conflicts of keys, the width of the external flap 56 is larger than that of the internal flap so that the introduction into the external rotor 34 of an unrecognised key cannot open the lock if a key is already present (clutch part 40 engaged) in the internal rotor 32 (thus profiting from prior recognition). Only a new recognition of this external key will tilt the external flap 56 and, by provoking a forward movement of the external clutch part 42 towards the key bit shall result in the linking barrels 66, 68 in pushing the internal clamp 44 and freeing the internal clutch part 40 so that a new engaging of the key bit by the external rotor becomes possible, despite the presence of the key in the internal rotor.

The key bit also comprises an annular conductive track 110 for co-operating with a fixed sole electric contact 112 of the barrel body so as to allow energy feeding of the motor means 50. In order to do this, the two portions of the barrel body each comprise a perforation 114, 116 perpendicular to the axis of the rotors and intended to receive an electric contact, preferably of the ball type 118, 120, for co-operating with a corresponding conductive element of the key 8, for example an electric contact or conductive track 122. The various electric contacts are interconnected through electronic circuits 30 placed in a cavity of the body of the barrel so that feeding from the motor means of the locking key bit can be effected directly from the key through these electronic circuits.

Figure 6:
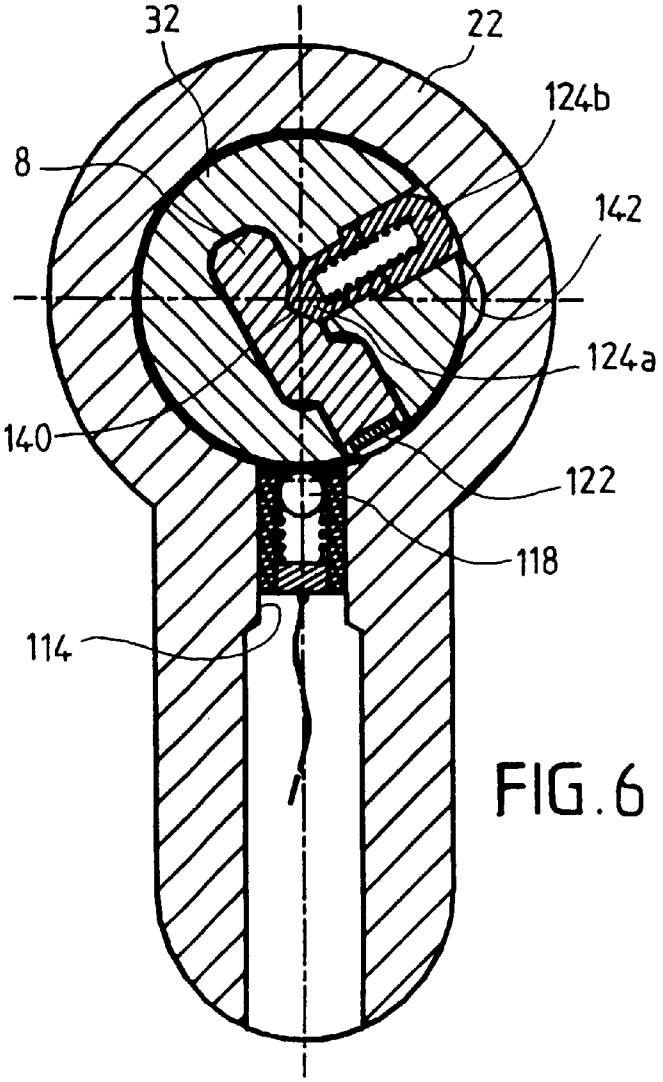
FIG. 6 is a cutaway view similar to that of FIG. 5, but after one rotation of the rotor.
Figure 5:
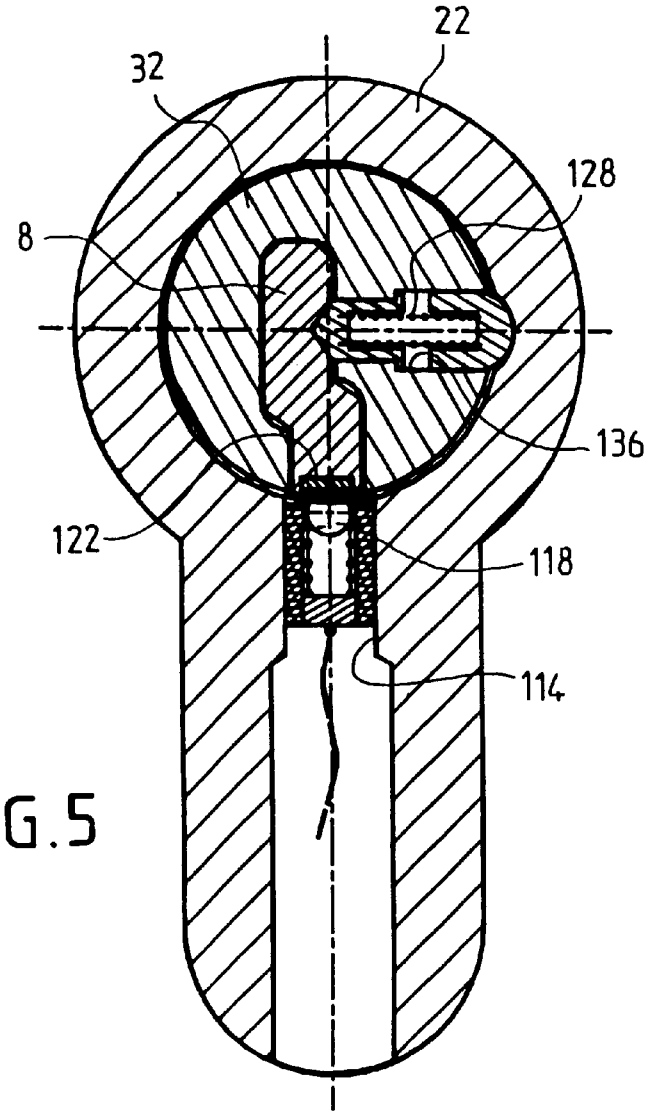
FIG. 5 is a section along the plane V—V of FIG. 4.

The locking of the key in the rotor when the latter rotates is normally ensured by a disengaging finger whose particular structure is shown in detail on FIGS. 5 and 6. This extremely simple structure is formed of two independent portions 124*a*, 124*b*; 126*a*, 126*b* spaced by a single spring 128, 130 kept in a blind hole 132*a*, 132*b*; 134*a*, 134*b* pierced in each of these two portions, preferably cylindrical (the two blind holes being opposite each other). The disengaging finger formed above is mounted perpendicular to the axis of the rotors in an opening 136, 138 partly traversing each rotor, a first extremity of this finger being flush with the key duct so as to co-operate with an orifice 140 of this key, whereas its second extremity, by going past the external wall of the rotor, comes into contact with a groove 142, 144 made longitudinally in the internal wall of the corresponding stator. In this embodiment example, which would not be restrictive, the compression of the sole spring (which prevents any removal of the key) made during the movement in rotation of the rotor after the key is introduced is rendered easier by a slanted portion of the groove of the internal wall of the stator on which the external portion of the disengaging finger shall slide.

The functioning of the double barrel illustrated is as follows. First of all, it is assumed that no key is introduced into the lock. The two rotors are thus in a first idle position and are free in rotation. The clutch parts are connected to the rotors but not to the key bit. In this initial state, the protection flaps are in a first position (initial closed position) in which movement of the clutch parts towards the key bit is impossible. The key bit is kept by the indexing finger in a position offset with respect to vertical and preferably about 30°.

When a key is introduced (for example at the level of the internal rotor), the disengaging finger is drawn aside to allow the key to pass (more specefically the blade or rod of this key) which then shall come to a stop a the bottom of the key duct of the rotor. From this contact with the bottom of the rotor result in a movement of the associated clutch part whilst compressing thrust of the rotor which shall move forward until coming into contact with the half circlips. The movement of the rotor results in a movement of the associated clutch part whilst compresing the linking spring and the forward movement of the return clamp integral with the rotor ensures a movement of the linking barrels so as to prevent the key being introduced in the opposing rotor (in the space of the external rotor). During these movements, the conductive track of the key is automatically electrically connected with the ball contact of the barrel (several fractions of seconds suffice to ensure this linking). From this point, an exchange of information between the key and the barrel can be effected between the memory means of the key and those of the barrel to obtain a recognition of the respective identification codes. If this recognition proves to be conclusive (which means that the key has a right of access to the barrel), the electric micromotor is fed ensuring via its drive pinion a pivoting of the sector gear. The protection flaps tilt by stressing the return spring and free the clutch which, under the effect of the expansion of the compression spring, advances towards the key bit as soon as the opening angle of the flap permits this. This movement places the clutch part in gear with the key bit which thus only needs one rotation of the key to move. The opening torque is thus transmitted form the rotor to the clutch part and then to key bit by the various mesh means (grooves) of these three components. In addition, on staring of rotation, the key is locked inside the rotor owing to locking of the resultant disengaging finger of the outlet of the groove of the internal stator.

On removal of the key, the rotor returns to its initial position under the action of the disengaging finger, the return clamp bringing the clutch part back towards the rotor. In its return travel, the clutch part shall free the protection flap which shall automatically resume its initial closed position under the action of the return spring.

The structure described above is particularly simple and consumes a small amount of energy. In fact, the protection flap is automatically kept in a freed position (disengaged) by the clutch part once the latter gears with the key bit. A continuous feeding of the motor is thus not necessary and only one initial pulse for freeing this clutch part is essential for the proper functioning of the barrel. Moreover, it could be noted that in the illustrated version (double barrel), a single motor ensures tilting of the two protection flaps.

What is claimed is:

1. Electronic barrel comprising a barrel body (12, 14) and a rotary-lock key bit (10), the barrel body comprising at least one rotor (32, 34) having a common axis with the body and the rotary-lock key bit and freely rotating in said body, a clutch part (40,42) coupled in rotation with the rotor and comprising meshing means (82, 84) co-operating with additional means (86,88) matching the key bit so as to drive in rotation said key bit by the rotor under the action of a rotating torque of the key (8), and locking means (50, 60) for preventing the clutch part (40, 42) from being translated when there is no recognition of an identification code transmitted between the key and the barrel, characterised in that said locking means are further mounted integral in the rotary-lock key bit and the rotor is mobile in translation for thrusting the clutch part towards the key bit when said identification code is recognised.

2. Electronic barrel according to claim 1, wherein said locking means comprise at least one stop (54, 56) freed by motor means (50, 58, 60) when said identification code is recognised.

3. Electronic barrel according to claim 2, wherein at least one stop is constituted by a protection flap pivoting around an axis (52) parallel to the axis of at least one rotor between an initial position and a final freeing position.

4. Electronic barrel according to claim 2, wherein said motor means comprise an electric microactuator (50) with an axis parallel to the axis of at least one rotor, the at least one stop being freed by means of a drive pinion (60) borne by a final drive shaft of the electric microactuator and gearing on a sector gear (58) integral with the stop.

5. Electronic barrel according to claim 3, wherein the protection flap acts against the action of a return spring (62) intended to automatically bring the protection flap back into the initial position when the key is removed.

6. Electronic barrel according to claim 1, wherein said clutch part is formed of a cylindrical ring fitted with a central disk (102, 104) and comprising on both sides of this central disk meshing means (74, 76; 82, 84) in the shape of grooves so as to ensure coupling in rotation with firstly the key bit and secondly with the rotor.

7. Electronic barrel according to claim 6 and claim 2, wherein said central disk of the clutch part comprises a central heel (78, 80) for co-operating with the stop (54, 56) for freeing the clutch part.

8. Electronic barrel according to claim 1, further comprising at least one compression (90, 92) inserted between the rotor (32, 34) and the clutch part (40, 42).

9. Electronic barrel according to claim 1, further comprising at least a return clamp (44, 46) integral with the rotor (32, 34) and intended to co-operate with the clutch part (40, 42) to enable the clutch part to be freed from the key bit (10) when the key is removed.

10. Electronic barrel according to claim 9, wherein said return clamp comprises an annular disk (94, 96) fitted with at least one foot (98, 100) traversing the clutch part and fixed to the rotor, the disk co-operating with a surface of the clutch part perpendicular to the axis, of at lease one rotor.

11. Electronic barrel according to claim 1, further comprising at least one circlip (18, 20) integral with the body of the barrel and intended to limit the translation of at least one rotor (32, 34) in the direction of the key bit.

12. Electronic barrel according to claim 1, further comprising at least one disengaging finger formed of two independent portions **(124*a*, 124*b*; 126*a*, 126*b*) spaced by a single compression spring (128, 130) and intended to ensure locking of the key (8) in the rotor to enable the clutch part (40, 42) to be freed from the rotary-lock key bit (10)** when the key is removed.

13. Electronic barrel according to claim 12, wherein said disengaging finger is mounted perpendicular to the axis of at least one rotor in an opening (136, 138) partly traversing the rotor, a first extremity of this disengaging finger being flush in the key duct (36, 38) so as to come into contact with an orifice (140) of the key (8) and a second extremity going past the external wall of the rotor so as to come into contact with a longitudinal groove (142, 144) of the internal wall of the body of the barrel.

14. Electronic barrel according to claim 13, wherein said groove of the internal wall of the barrel body comprises at least one slanted portion so as to facilitate compression of the sole spring (128, 130) when the rotor is moved after the key is introduce.

15. Electronic barrel according to claim 2, wherein said key bit comprises an annular conductive track (110) for co-operating with a sole fixed electric contact (112) of the body of the barrel as to permit energy feeding from motor means.

16. Electronic barrel according to claim 1, wherein the barrel body comprises at least one perforation (114, 116) perpendicular to the axis of at least one rotor for receiving an electric contact, preferably of the ball type (118, 120), for co-operating with a corresponding conductive element (122) of the key (8).

17. Electronic barrel according to claim 15 and claim 16, further comprising electronic circuits (30) placed in a cavity of the body of the barrel and connected firstly to at least the electric ball contact (118, 120) and secondly to the sole fixed electric contact (112) so that feeding the key bit from the motor means (50) can be effected directly from the key through the electronic circuits.

18. Electronic barrel according to claim 1, comprising:

a first rotor or internal rotor and a second rotor or external rotor, characterized in that the width of the protection flap of the external rotor is larger than that of the protection flap of the internal rotor so that the introduction of an unrecognized key in the external key duct does not allow driving of the key bit when a key is present in the internal key duct.

19. Electronic barrel according to claim 18, further comprising at least one linking barrel (66, 68) having a length larger than the width of the key bit and placed at the level of this key bit (10) between the return clamps (44, 46) and intended to co-operate with the latter to prevent the simultaneous engaging of the internal and external rotors (32, 24) when two keys are introduced into the two key ducts (36, 38).

20. Lock with one or two rotors fitted with an electronic barrel according to one of claims 1 to 19.

21. Electronic barrel according to claim 2, wherein said central disk of the clutch part comprises a central heel for cooperating with the stop for freeing this part.

22. Electronic barrel according to claim 16, furthers comprising electronic circuits placed in a cavity of the body of the barrel and connected firstly to at least the electric ball contact and secondly to the sole fixed electric contact so that feeding the key bit from the motor means can be effected directly from the key through the electronic circuits.

* * * * *